US011842686B2

(12) United States Patent
Kim

(10) Patent No.: US 11,842,686 B2
(45) Date of Patent: Dec. 12, 2023

(54) LIGHT EMITTING DISPLAY DEVICE AND DRIVING METHOD THEREOF

(71) Applicant: LG Display Co., Ltd., Seoul (KR)

(72) Inventor: Hyung Jung Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/945,571

(22) Filed: Sep. 15, 2022

(65) Prior Publication Data

US 2023/0215355 A1 Jul. 6, 2023

(30) Foreign Application Priority Data

Dec. 30, 2021 (KR) ..... 10-2021-0193365

(51) Int. Cl.
*G09G 3/3233* (2016.01)

(52) U.S. Cl.
CPC ... *G09G 3/3233* (2013.01); *G09G 2300/0452* (2013.01); *G09G 2310/0286* (2013.01); *G09G 2310/08* (2013.01); *G09G 2320/0233* (2013.01); *G09G 2320/0666* (2013.01); *G09G 2330/023* (2013.01); *G09G 2360/16* (2013.01)

(58) Field of Classification Search
None
See application file for complete search history.

(56) References Cited

U.S. PATENT DOCUMENTS

2010/0013748 A1* 1/2010 Cok ..... H04N 9/67 382/167
2013/0235065 A1 9/2013 Kaida et al.
2014/0176625 A1 6/2014 Yoon et al.
2018/0151104 A1 5/2018 Heo et al.

FOREIGN PATENT DOCUMENTS

KR 10-1366596 B1 3/2014
KR 10-2018-0062129 A 6/2018
KR 10-1992904 B1 6/2019
KR 10-2113613 B1 5/2020
KR 10-2154698 B1 9/2020

* cited by examiner

*Primary Examiner* — Christopher J Kohlman
(74) *Attorney, Agent, or Firm* — Morgan, Lewis & Bockius LLP

(57) ABSTRACT

A light emitting display device and driving method are disclosed. A light emitting display device includes a display panel including RGBW sub-pixels; a driver configured to drive the display panel; and a timing controller configured to control the driver, wherein W peak luminance derived by the W sub-pixels is higher than a sum of RGB peak luminances derived by the RGB sub-pixels when the display panel displays an image.

13 Claims, 13 Drawing Sheets

[Night scenery with few W images]

Embodiment (CAPL) [ RGB − W ↓ ]

Comparative example (APL) [ RGB ↓ W ↓ ]

[Daytime scenery with many W images]

| | |
|---|---|
| Embodiment (CAPL) | [ RGB – W ↑ ] |
| Comparative example (APL) | [ RGB ↑ W ↑ ] |

[Night scenery with few W images]

Embodiment (CAPL) [ RGB ↑ W ↓ ]

Comparative example (APL) [ RGB ↓ W ↓ ]

[Daytime scenery with many W images]

| | |
|---|---|
| Embodiment (CAPL) | [ RGB ↓ W ↑ ] |
| Comparative example (APL) | [ RGB ↑ W ↑ ] |

LIGHT EMITTING DISPLAY DEVICE AND DRIVING METHOD THEREOF

This application claims the benefit of Korean Patent Application No. 10-2021-0193365, filed on Dec. 30, 2021, which is hereby incorporated by reference as if fully set forth herein.

BACKGROUND

Technical Field

The present invention relates to a light emitting display device and a driving method thereof.

Discussion of the Related Art

With the development of information technology, the market for display devices, which are connection media between users and information, is growing. Accordingly, display devices such as a light emitting display (LED) device, a quantum dot display (QOD) device, and a liquid crystal display (LCD) device are increasingly used.

The display devices described above include a display panel including sub-pixels, a driver outputting a driving signal for driving the display panel, a power supply generating power to be supplied to the display panel or the driver, and the like.

In the aforementioned display devices, when driving signals, for example, a scan signal and a data signal, are supplied to the sub-pixels formed in the display panel, selected sub-pixels transmit light or directly emit light, thereby displaying an image.

SUMMARY

Accordingly, embodiments of the present disclosure are directed to a light emitting display device and a driving method thereof that substantially obviate one or more of the problems due to limitations and disadvantages of the related art An aspect of the present disclosure is to reduce power consumption while enabling image quality enhancement for increasing W luminance in consideration of color additivity.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a light emitting display device comprises a display panel including RGBW sub-pixels, a driver configured to drive the display panel, and a timing controller configured to control the driver, wherein W peak luminance derived by the W sub-pixels is higher than a sum of RGB peak luminances derived by the RGB sub-pixels when the display panel displays an image.

The timing controller may calculate at least one of a first average picture level that does not take a chroma component into account and a second average picture level taking the chroma component into account according to an input image at the time of calculating an average picture level for an image to be displayed on the display panel.

The timing controller may generate a peak luminance control signal for controlling the W peak luminance to be higher than the sum of the RGB peak luminances based on the second average picture level.

The second average picture level may be calculated based on the following formula, second average picture level (CAPL)=(total pixel sum (MAX(R,G,B)/255×((MAX(R,G,B)−(1−chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

The timing controller may generate a peak luminance control signal for decreasing W luminance derived by the W sub-pixels without changing RGB luminances derived by the RGB sub-pixels when there is a small number of W images in an input image.

The timing controller may generate a peak luminance control signal for increasing W luminance derived by the W sub-pixels without changing RGB luminances derived by the RGB sub-pixels when there is a large number of W images in an input image.

The timing controller may generate a peak luminance control signal for decreasing W luminance derived by the W sub-pixels instead of increasing RGB luminances derived by the RGB sub-pixels when there is a small number of W images in an input image.

The timing controller may generate a peak luminance control signal for increasing W luminance derived by the W sub-pixels instead of decreasing RGB luminances derived by the RGB sub-pixels when there is a large amount of W images in an input image.

In another aspect, a method of driving a light emitting display device comprises a display panel including RGBW sub-pixels, a driver configured to drive the display panel, and a timing controller for controlling the driver includes calculating at least one of a first average picture level that does not take a chroma component into account and a second average picture level taking a chroma component into account according to an input image, and generating a peak luminance control signal based on the first average picture level or the second average picture level, wherein W peak luminance derived by the W sub-pixels is higher than a sum of RGB peak luminances derived by the RGB sub-pixels when the display panel displays an image.

The second average picture level may be calculated based on the following formula, second average picture level (CAPL)=(total pixel sum (MAX(R,G,B)/255×((MAX(R,G,B)−(1−chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

In another aspect of the present invention, a light emitting display device includes a display panel including RGBW sub-pixels, a driver for driving the display panel, and a timing controller configured to control the driver, to calculate an average picture level taking a chroma component into account according to an input image, and to generate a peak luminance control signal for controlling W peak luminance to be higher than a sum of RGB peak luminances based on the average picture level taking the chroma component into account.

The display panel may display an image in which W peak luminance derived by the W sub-pixels is higher than a sum of RGB peak luminances derived by the RGB sub-pixels in response to the peak luminance control signal.

The average picture level may be calculated based on the following formula, CAPL=(total pixel sum (MAX(R,G,B)/255×((MAX(R,G,B)−(1 chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

DETAILED DESCRIPTION

A display device according to the present invention may be implemented as a television, a video player, a personal computer (PC), a home theater, an automobile electric device, a smartphone, and the like, but the present invention is not limited thereto. The display device according to the present invention may be implemented as a light emitting display (LED) device, a quantum dot display (QOD) device, a liquid crystal display (LCD) device, or the like. However, for convenience of description, a light emitting display device that directly emits light based on inorganic light emitting diodes or organic light emitting diodes will be exemplified below.

Figure 1:
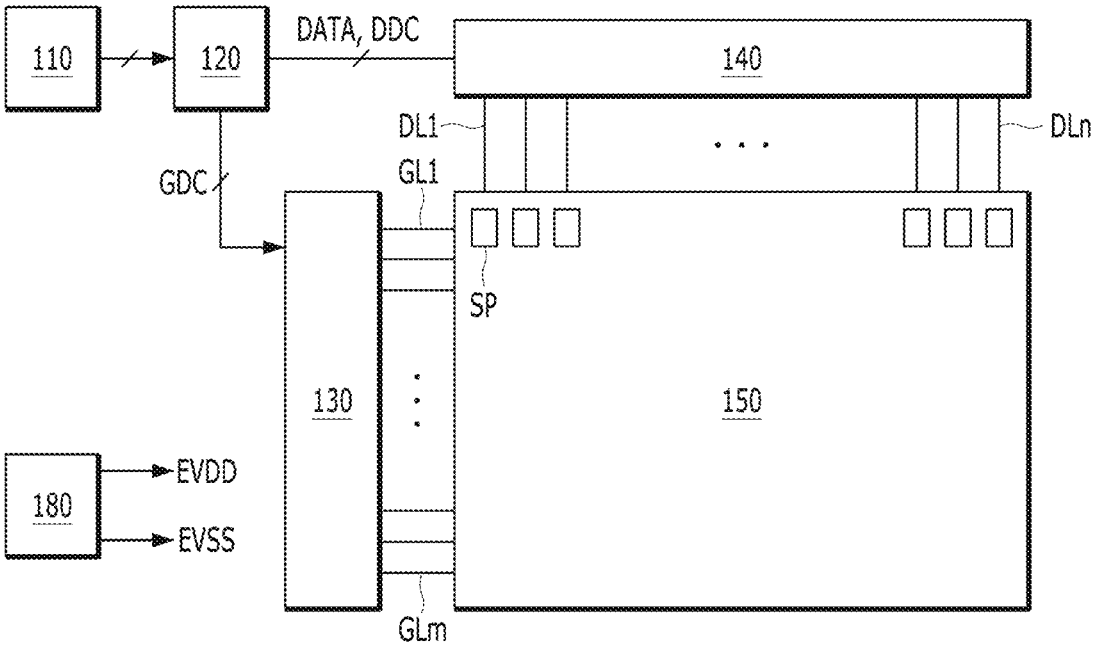
FIG. 1 is a block diagram schematically showing a light emitting display device.
Figure 2:
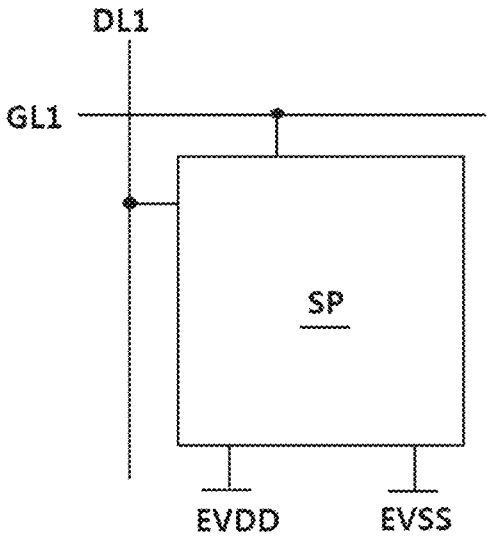
FIG. 2 is a configuration diagram schematically showing a sub-pixel illustrated in FIG. 1.

FIG. 1 is a block diagram schematically showing a light emitting display device, and FIG. 2 is a configuration diagram schematically showing a sub-pixel illustrated in FIG. 1.

As shown in FIGS. 1 and 2, the light emitting display device may include an image provider 110, a timing controller 120, a scan driver 130, a data driver 140, a display panel 150, a power supply 180, and the like.

The image provider (set or host system) 110 may output various driving signals along with an image data signal supplied from the outside or an image data signal stored in an internal memory. The image provider 110 may supply a data signal and various driving signals to the timing controller 120.

The timing controller 120 may output a gate timing control signal GDC for controlling the operation timing of the scan driver 130, a data timing control signal DDC for controlling the operation timing of the data driver 140, and various synchronization signals (vertical synchronization signal Vsync and horizontal synchronization signal Hsync). The timing controller 120 may supply a data signal DATA supplied from the image provider 110 along with the data timing control signal DDC to the data driver 140. The timing controller 120 may take the form of an integrated circuit (IC) and be mounted on a printed circuit board, but is not limited thereto.

The scan driver 130 may output a scan signal (or a scan voltage) in response to the gate timing control signal GDC supplied from the timing controller 120. The scan driver 130 may supply scan signals to sub-pixels included in the display panel 150 through gate lines GL1 to GLm. The scan driver 130 may be take the form of an IC or may be directly formed on the display panel 150 in a gate-in-panel structure, but is not limited thereto.

The data driver 140 may sample and latch the data signal DATA in response to the data timing control signal DDC supplied from the timing controller 120, convert the digital data signal into an analog data voltage based on a gamma reference voltage, and output the analog data voltage. The data driver 140 may supply a data voltage to the sub-pixels included in the display panel 150 through data lines DL1 to DLn. The data driver 140 may take form of an IC and be mounted on the display panel 150 or mounted on a printed circuit board, but is not limited thereto.

The power supply 180 may generate first power having high potential and second power having low potential based on external input power supplied from the outside, and output the first power and the second power through a first power line EVDD and a second power line EVSS. The power supply 180 may generate and output voltages (e.g., gate voltages including a gate high voltage and a gate low voltage) necessary to drive the scan driver 130 and voltages (drain voltages including a drain voltage and a half drain voltage) necessary to drive the data driver 140 as well as the first power and the second power.

The display panel 150 may display an image in response to driving signals including a scan signal and a data voltage, the first power, the second power, and the like. The sub-pixels of the display panel 150 directly emit light. The display panel 150 may be manufactured based on a substrate having rigidity or flexibility, such as glass, silicon, polyimide, or the like. In addition, the sub-pixels that emit light may include red, green, and blue pixels or include red, green, blue, and white pixels.

For example, one sub-pixel SP may be connected to the first data line DL1, the first gate line GL1, the first power line EVDD, and the second power line EVSS and may include a pixel circuit including a switching transistor, a driving transistor, a capacitor, an organic light emitting diode, and the like. Since the sub-pixel SP used in the light emitting display device directly emits light, the circuit configuration is complicated. In addition, there are various compensation circuits for compensating for deterioration of a driving transistor for supplying a driving current necessary to drive organic light emitting diodes emitting light as well as the organic light emitting diodes. Accordingly, it is noted that the sub-pixel SP is simply illustrated in the form of a block.

Meanwhile, in the above description, the timing controller 120, the scan driver 130, the data driver 140, and the like are described as individual components. However, depending on the implementation method of the light emitting display device, one or more of the timing controller 120, the scan driver 130, and the data driver 140 may be integrated into one IC.

Figure 3:
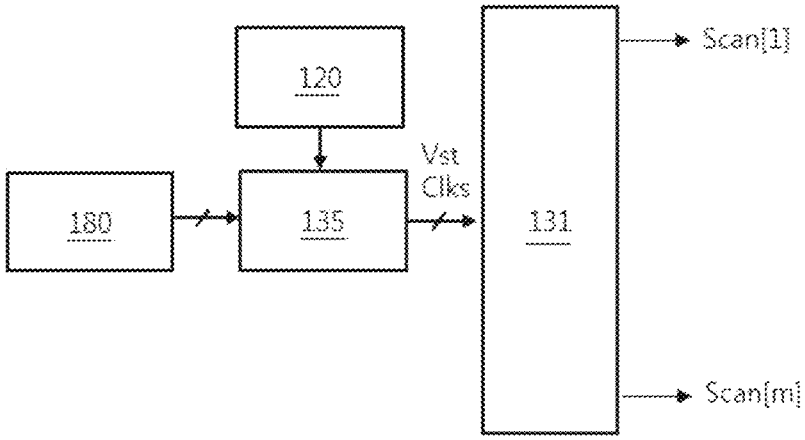
FIGS. 3 and 4 are diagrams for describing a configuration of a gate-in-panel type scan driver.
Figure 4:
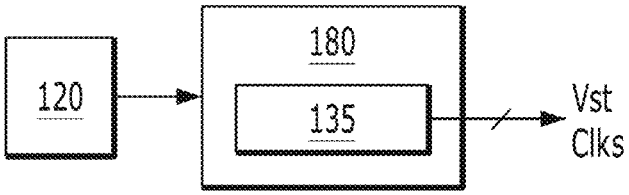
Figure 5A:
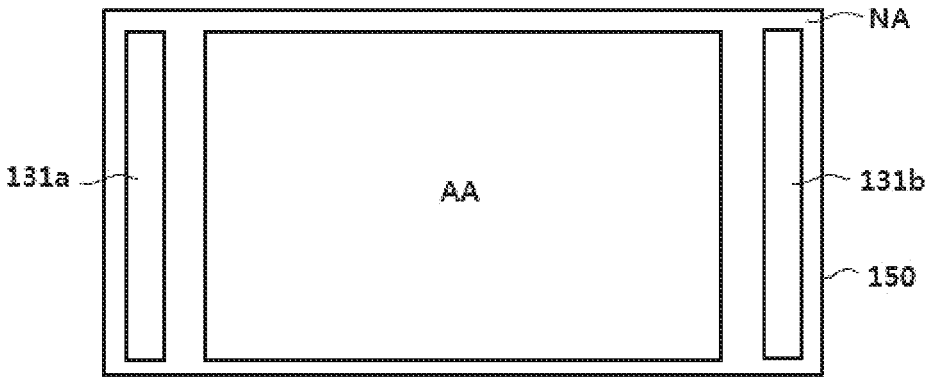
FIGS. 5A and 5B are a diagram showing an arrangement example of the gate-in-panel type scan driver.
Figure 5B:
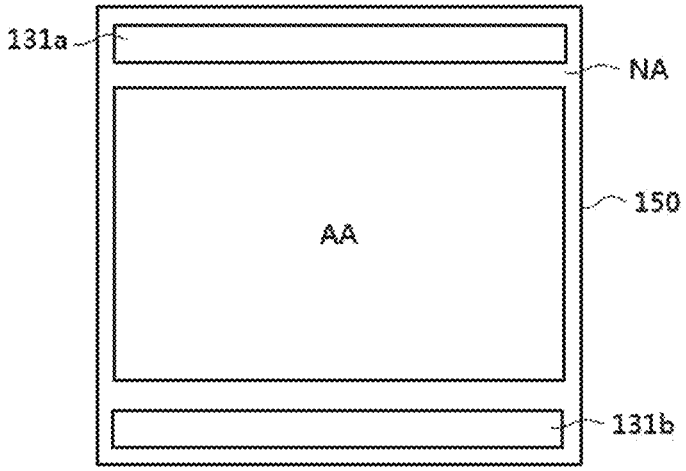

FIGS. 3 and 4 are diagrams for describing a configuration of a gate-in-panel type scan driver, and FIGS. 5A and 5B are a diagram illustrating an arrangement example of the gate-in-panel type scan driver.

As shown in FIG. 3, the gate-in-panel type scan driver 130 may include a shift register 131 and a level shifter 135. The level shifter 135 may generate driving clock signals Clks and a start signal Vst based on signals and voltages output from the timing controller 120 and the power supply 180. The driving clock signals Clks may be generated in the form of J different phases (J being an integer equal to or greater than 2) such as 2 phases, 4 phases, or 8 phases.

The shift register 131 operates based on the signals Clks and Vst output from the level shifter 135 and may output scan signals Scan[1] to Scan [m] for turning on or off transistors formed in the display panel. The shift register 131 may take the form of a thin film on the display panel in a gate-in-panel structure.

As shown in FIGS. 3 and 4, unlike the shift register 131, the level shifter 135 may be independently configured as an IC or may be included in the power supply 180. However, this is merely an example and the present invention is not limited thereto.

As shown in FIGS. 5A and 5B, shift registers 131*a* and 131*b* outputting scan signals in the gate-in-panel type scan driver may be disposed in a non-display area NA of the display panel 150. The shift registers 131*a* and 131*b* may be disposed in left and right non-display areas NA of the display panel 150 as shown in FIG. 5A or in upper and lower non-display areas NA of the display panel 150 as shown in FIG. 5B. Although an example in which the shift registers 131*a* and 131*b* are disposed in the non-display areas NA is illustrated in FIGS. 5A and 5B, the present invention is not limited thereto.

Figure 8:
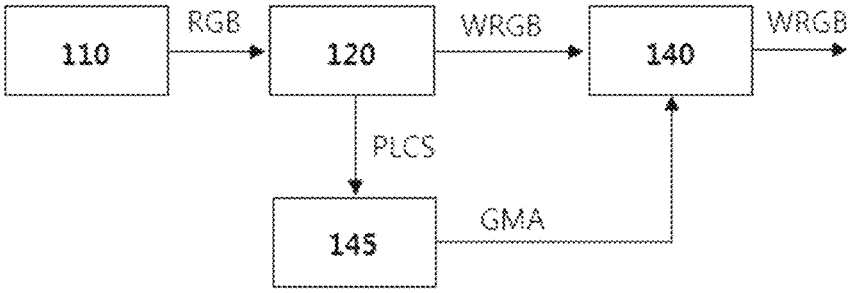
Figure 9:
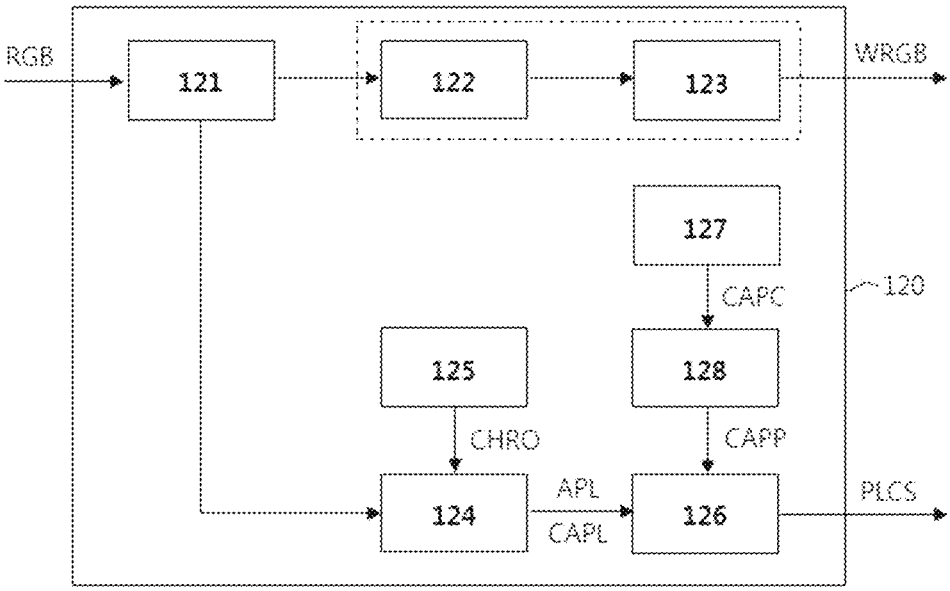
Figure 10:
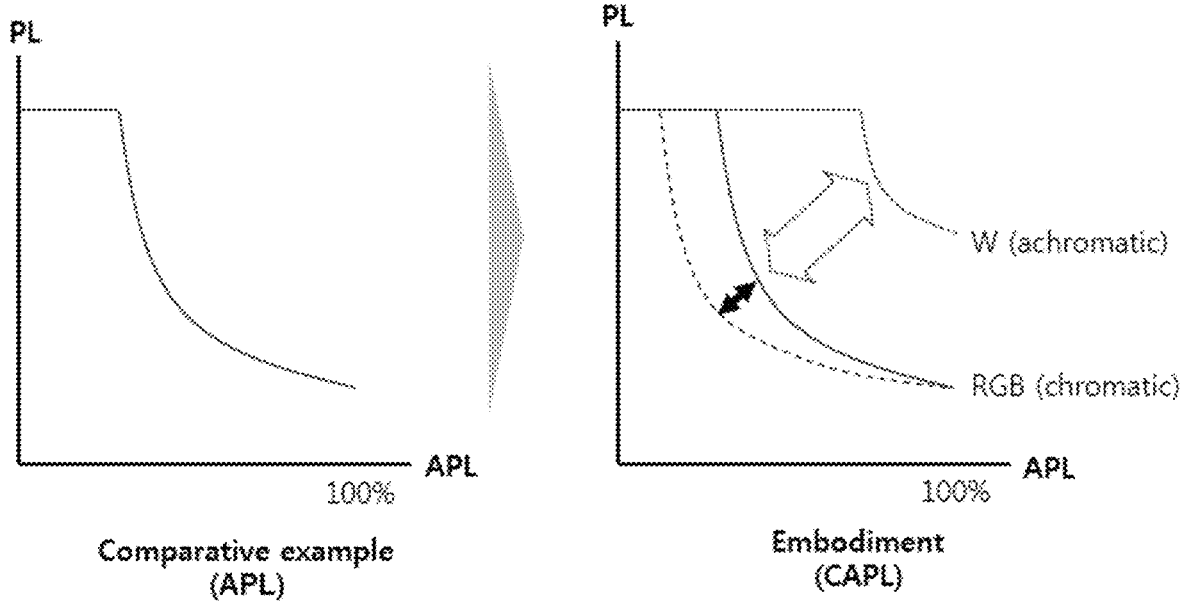
FIG. 10 is diagram showing peak luminance control curves for describing a peak luminance control method according to an embodiment in comparison to a peak luminance control method according to a comparative example.

FIGS. 6 to 9 are diagrams for describing a light emitting display device according to an embodiment of the present invention, FIG. 10 is diagram showing peak luminance control curves for describing a peak luminance control method according to an embodiment in comparison to a peak luminance control method according to a comparative example, and FIGS. 11 to 14 are diagrams showing luminance control curves for describing differences between the peak luminance control method according to the comparative example and the peak luminance control method according to the embodiment.

Figure 6:
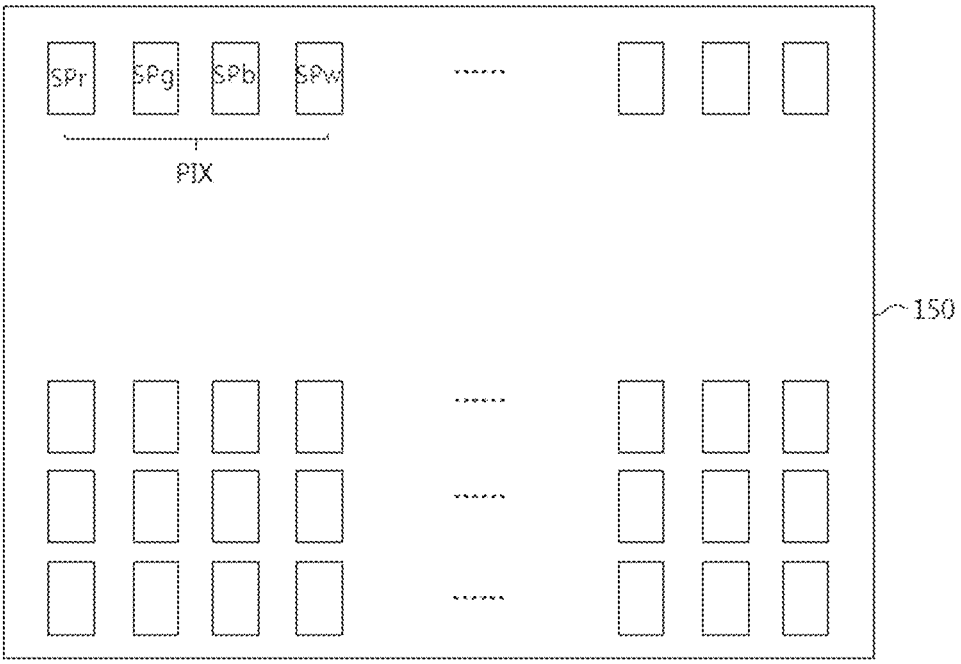
FIGS. 6 to 9 are diagrams for describing a light emitting display device according to an embodiment of the present invention.

As shown in FIG. 6, the light emitting display device according to the embodiment of the present invention can display an image based on the display panel 150 including pixels PIX arranged in a matrix form. One pixel PIX disposed in the display panel 150 may include a red sub-pixel SPr, a green sub-pixel SPg, a blue sub-pixel SPb, and a white sub-pixel SPw.

Figure 7:
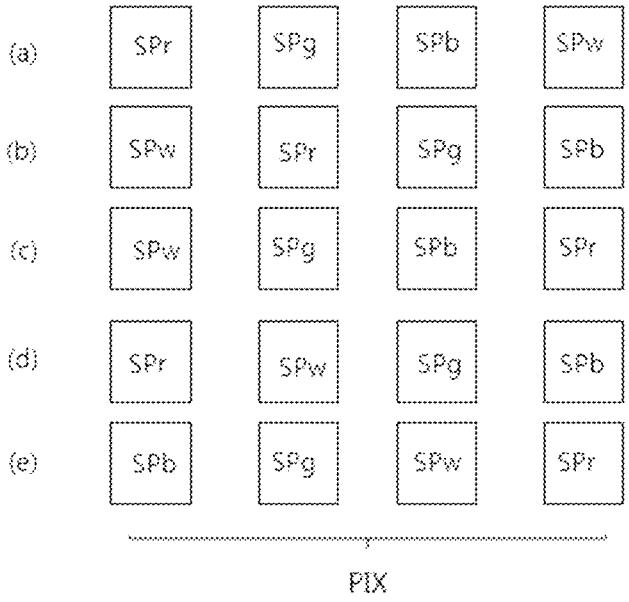

As shown in (a) to (e) of FIG. 7, arrangement order of the red sub-pixel SPr, the green sub-pixel SPg, the blue sub-pixel SPb, and the white sub-pixel SPw included in one pixel PIX may be changed depending on the implementation method of the display panel.

As shown in FIGS. 6 and 8, the timing controller 120 may process red, green, and blue data signals (hereinafter, RGB data signals) RGB applied from the image provider 110 to convert the same into white, red, green, and blue data signals (hereinafter referred to as WRGB data signals) WRGB and output the WRGB data signals WRGB. To drive the display panel 150 including the red sub-pixel SPr, the green sub-pixel SPg, the blue sub-pixel SPb, and the white sub-pixel SPw, it is necessary to generate WRGB data signals from RGB data signals through image processing of the timing controller 120 as described above.

Further, the timing controller 120 may output a peak luminance control signal PLCS for changing a gamma voltage value GMA output from a gamma unit 145. The data driver 140 may generate a data voltage to be applied to the display panel based on the WRGB data signals WRGB output from the timing controller 120 and the gamma voltage value GMA output from the gamma unit 145. Accordingly, in order to control a peak luminance of the display panel, it is necessary to generate the peak luminance control signal PLCS in response to image processing of the timing controller 120.

As shown in FIG. 9, the timing controller 120 may perform various types of image processing in order to generate the peak luminance control signal PLCS along with white, red, green, and blue data signals WRGB. To this end, the timing control unit 120 may include a degamma unit 121, a data conversion unit 122, an image processing unit 123, an average picture level calculation unit 124, a saturation control unit 125, a peak luminance control unit 126, a chroma current control unit 127, a chroma peak control unit 128, and the like.

The degamma unit 121 may perform digamma processing on RGB data signals RGB included in one frame. The degamma unit 121 may perform degamma processing on inverse gamma data which has received to prevent bit overflow that may be caused during the operation of converting RGB data signals RGB input from the outside into RGBW data signals RGBW to convert the inverse gamma into a linear form, and then perform bit stretching. The degamma unit 121 may perform bit stretching using a degamma lookup table, but is not limited thereto.

The data conversion unit 122 may serve to convert RGB data signals RGB output through the degamma unit 121 into RGBW data signals RGBW. The data conversion unit 122 may convert the RGB data signals RGB into the RGBW data signals RGBW based on a conversion formula set therein.

The image processing unit 123 may serve to perform various types of image processing on the RGBW data signals RGBW output through the data conversion unit 122. The image processing unit 123 may add or subtract a gain or a specific weight for compensating for the RGBW data signals RGBW. Meanwhile, the data conversion unit 122 and the image processing unit 123 may be integrated into one and may be referred to as an algorithm processing unit.

The average picture level calculation unit 124 may serve to calculate an average picture level by calculating an average representative value of the RGB data signals RGB output through the degamma unit 121. The average picture level calculation unit 124 may calculate the average picture level from the RGB data signals RGB or YCbCr data signals converted from the RGB data signals RGB.

The average picture level calculation unit 124 may recalculate the pre-calculated average representative value for each specific frame such that the same average picture level is applied to a plurality of frames in order to reduce flicker and the like.

The chroma control unit 125 may selectively associate with the average picture level calculation unit 124 such that a chroma component is further considered during calculation of the average picture level. The chroma control unit 125 may have a quantitative chroma component value CHRO depending on a chroma component after extracting a chroma amount from RGB data signals RGB and image-processing the same.

The chroma control unit 125 may or may not transmit the chroma component value CHRO to the average picture level calculation unit 124 for selective association with the average picture level calculation unit 124. According to selective association with the chroma control unit 125, the average picture level calculation unit 124 may calculate a first average picture level APL that does not take the chroma component into account and a second average picture level CAPL taking the chroma component into account. When the chroma control unit 125 is associated, the average picture level calculation unit 124 may calculate the second average picture level CAPL based on the following formula.

$$\text{CAPL}=(\text{total pixel sum}(\text{MAX}(R,G,B)/255\times((\text{MAX}(R,G,B)-(1-\text{chroma gain})\times\text{MIN}(R,G,B))/\text{MAX}(R,G,B)))/\text{total pixel count})\times 100$$

In the above formula, the total pixel sum is the sum of all pixels, MAX(R,G,B) is the maximum value of RGB data signals, MIN(R,G,B) is the minimum value of the RGB data signals, chroma gain is a gain value depending on a chroma component, and total pixel count is a count value of all pixels. In the above formula, chroma gain may be 0.0 to 1.0.

As can be ascertained from the above formula, the chroma component value CHRO transmitted from the chroma control unit 125 to the average picture level calculation unit 124 may correspond to a gain value depending on the chroma component.

The chroma current control unit 127 and the chroma peak control unit 128 may selectively associate with the peak luminance control unit 126 such that a current according to chroma and a peak luminance according to chroma are controlled when the average picture level calculation unit 124 calculates the second average picture level CAPL.

The chroma current control unit 127 and the chroma peak control unit 128 generate reference values such that a current value CAPC according to the second average picture level and a peak luminance value CAPP according to the second average picture level are further taken into account when the peak luminance control unit 126 generates the peak luminance control signal PLCS, and thus they can be integrated into the chroma control unit 125.

The peak luminance control unit 126 may control a peak luminance for each frame using the first average picture level APL or the second average picture level CAPL calculated by the average picture level calculation unit 124. The peak luminance control unit 126 may output the peak luminance control signal PLCS for changing the gamma voltage value output from the gamma unit based on the first average picture level APL or the second average picture level CAPL.

Since the control method according to the embodiment controls the peak luminance by quantifying the chroma component, it is possible to realize higher W luminance compared to the conventional W luminance even if RGB pure color regions are lowered. Accordingly, the control method according to the embodiment can increase the W luminance while reducing power consumption as the RGB pure color regions are lowered.

As shown in FIG. 10, in a control method according to a comparative example, a peak luminance PL is determined based on the first average picture level APL that does not take a chroma component into account. On the other hand, in the control method according to the embodiment, the peak luminance PL is determined based on the second average picture level CAPL taking a chroma component into account. Meanwhile, it is noted that FIG. 10 shows an exaggerated W peak luminance curve for better understanding of the embodiment.

The control method according to the embodiment enables independent control of an achromatic portion and a chromatic portion such that RGB peak luminances are maintained without being lowered or changed when the W peak luminance is changed. In addition, in the control method according to the embodiment, the RGB peak luminances and W peak luminance do not vary together but independently vary, but the RGB peak luminances and W peak luminance may vary according to a gain value according to a chroma component or a correction variable.

Figure 11:
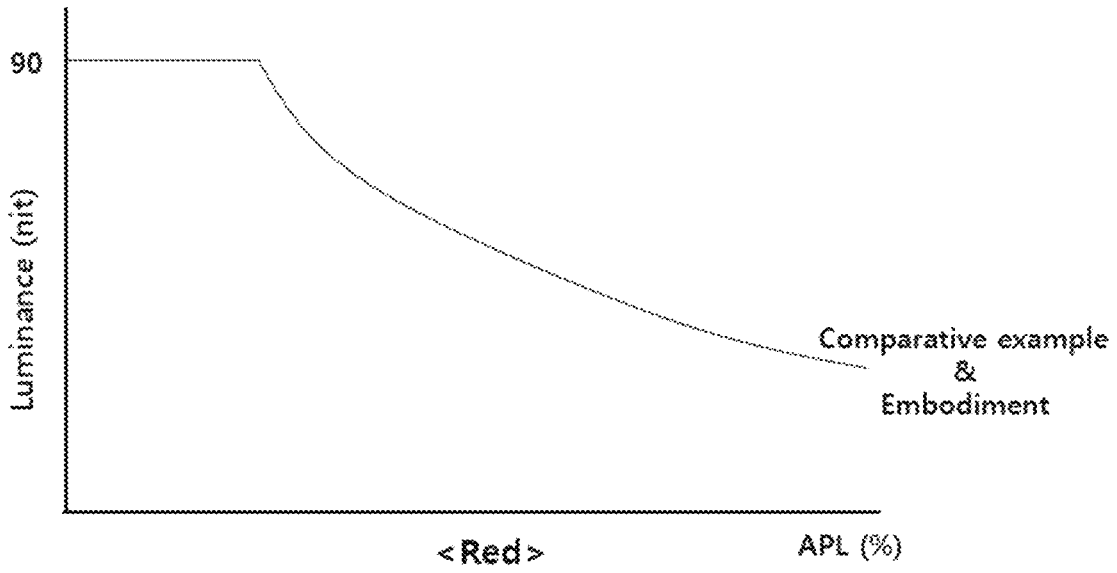
FIGS. 11 to 14 are diagrams showing luminance control curves for describing differences between the peak luminance control method according to the comparative example and the peak luminance control method according to the embodiment.
Figure 12:
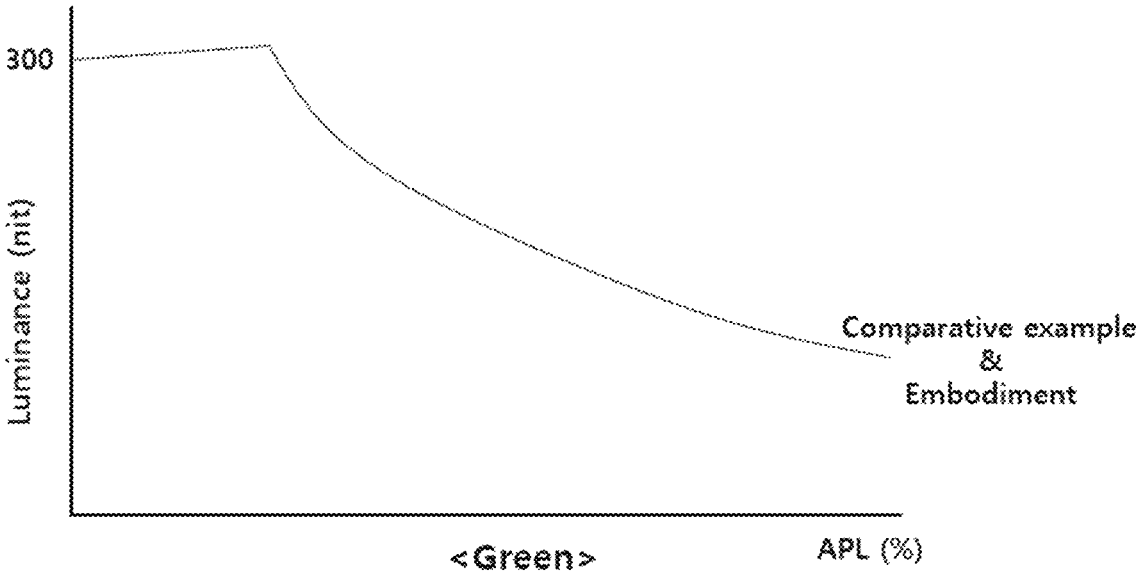
Figure 13:
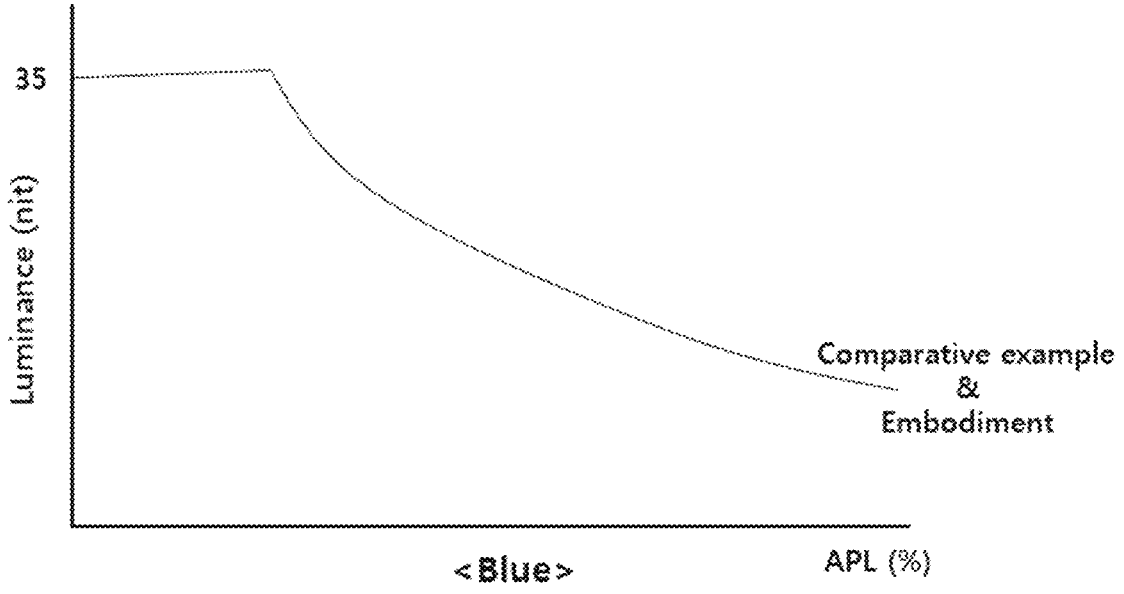
Figure 14:
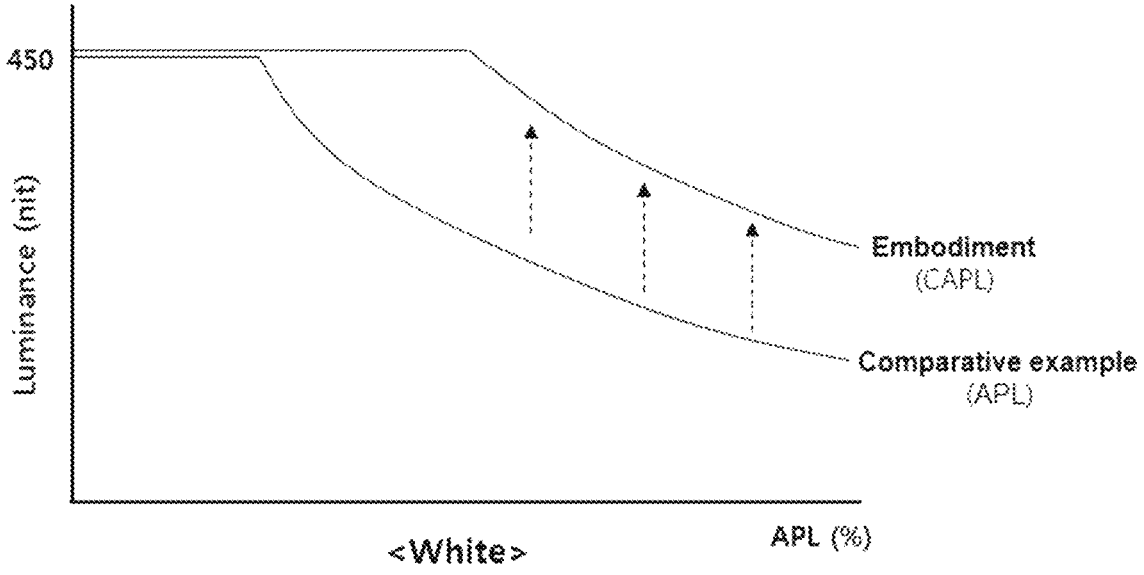

As shown in FIGS. 11 to 13, the control method according to the embodiment may achieve the same RGB peak luminances as those of the comparative example. However, as shown in FIG. 14, the control method according to the embodiment can increase the W peak luminance as compared to the control method of the comparative example (refer to the embodiment (CAPL) and the comparative example (APL) of FIG. 14) L) and Refer to Comparative Example (APL)) such that peak output corresponding to the efficiency of elements formed in the display panel can be achieved. That is, the control method according to the embodiment can control W alone to realize maximum efficiency without RGB control.

In general, although a method of displaying an image based on RGBW sub-pixels can use high-efficiency characteristics of W sub-pixels (high-efficiency sub-pixels) without color filters, it is desirable to consider color additivity in order to use the high-efficiency characteristics of W sub-pixels to the maximum. For this reason, the control method according to the embodiment calculates an average picture level in consideration of a chroma component value related to color additivity in order to use the high-efficiency characteristics of the W sub-pixels to the maximum and varies peak luminances of RGBW sub-pixels based thereon.

Hereinafter, differences between the control method according to the comparative example and the control method according to the embodiment when each of RGBW sub-pixels expresses a full-size pattern will be described.

In the comparative example, an image may be expressed with R=20 nit, G=70 nit, B=10 nit, and W=100 nit to match a color ratio. That is, in the comparative example, a relationship of "R peak luminance+G peak luminance+B peak luminance=W peak luminance" can be set such that the sum of the RGB peak luminances is the same as the W peak luminance.

On the other hand, in the embodiment, the luminances of RGB can be controlled to be lower and the luminance of W can be controlled to be higher, such as R=10 nit, G=35 nit, B=5 nit, and W=200 nit, and the luminances of RGB and W may be independently controlled. That is, the embodiment may set a relationship of "R peak luminance+G peak luminance+B peak luminance<W peak luminance" in which the W peak luminance is higher than the sum of the RGB peak luminances.

Note that a luminance change width of RGBW can be set differently depending on products to which the display device is applied. In addition, it is noted that, during actual output, the corresponding luminance may be automatically changed by an internal algorithm according to an output image in association with chroma. Further, the W luminance of the display panel may be changed depending on chroma.

The control method according to the embodiment is a method of controlling luminance depending on chroma. Accordingly, when the display device is driven by the control method according to the embodiment, W luminance may be higher than that during a default operation (normal operation) when the chroma is low. For example, when the luminance set in a product is 150 nits, a luminance of 250 nits or more can be achieved when the control method according to the embodiment is used. In addition, at the time of operation through the control method according to the embodiment, even if R luminance set in the product is 50 nits, an image may be displayed with 25 nits because RGB luminances can be simultaneously lowered.

Hereinafter, differences between the control method according to the comparative example and the control method according to the embodiment when a specific image (e.g., an image in which grayscales of a rainbow pattern based on RGB are gradually changed) is displayed on the display panel and then the luminance is changed will be described.

In the comparative example, the sum of RGB luminances (or the sum of RGB peak luminances) may be different from W luminance (or W peak luminance) when an image expressing the same grayscale in one frame image is measured. This is because luminances are varied (the sum of the RGB luminances is not equal to the W luminance) in such a manner that the RGB luminances or the W luminance is forcibly increased or decreased without considering color additivity in the comparative example.

On the other hand, in the embodiment, the sum of RGB luminances (or the sum of RGB peak luminances) may be equal to W luminance (or W peak luminance) when an image expressing the same grayscale in one frame image is measured. This is because the luminances are varied (the sum of the RGB luminances corresponds to the W luminance) in consideration of color additivity such that the relationship of RGB luminances=W luminance is maintained in the embodiment.

Hereinafter, differences between the peak luminance control method according to the comparative example and the peak luminance control method according to the embodiment in a case where there is a small number of W images (including a case where there are no W images) and a case where there is a large number of W images will be described.

FIGS. 15 to 18 are exemplary diagrams showing differences between the peak luminance control method according to the comparative example and the peak luminance control method according to the embodiment.

Figure 15:
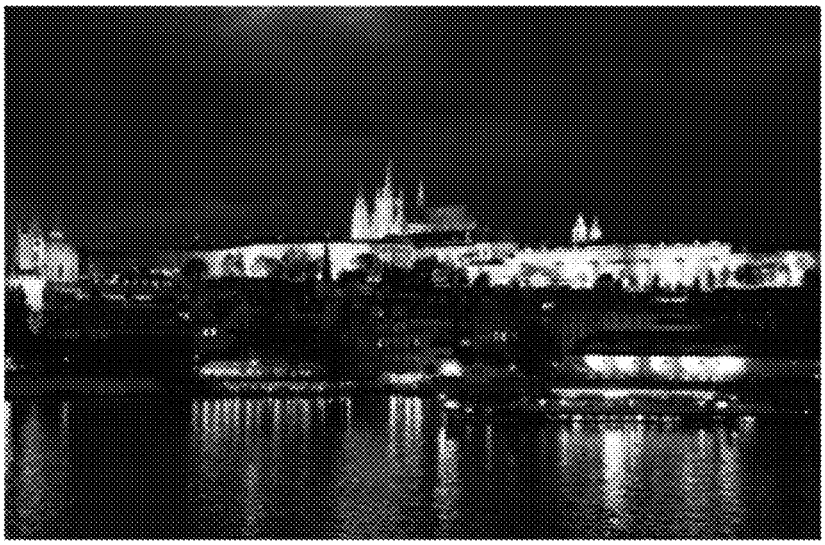
FIGS. 15 to 18 are exemplary diagrams showing differences between the peak luminance control method according to the comparative example and the peak luminance control method according to the embodiment.

When there is a small number of W images as in the first example of FIG. 15, it is possible to decrease only W luminance without varying RGB luminances in the control method (CAPL) according to the embodiment because independent control can be performed, whereas both the RGB luminances and the W luminance may be decreased in the control method (APL) according to the comparative example.

Figure 16:
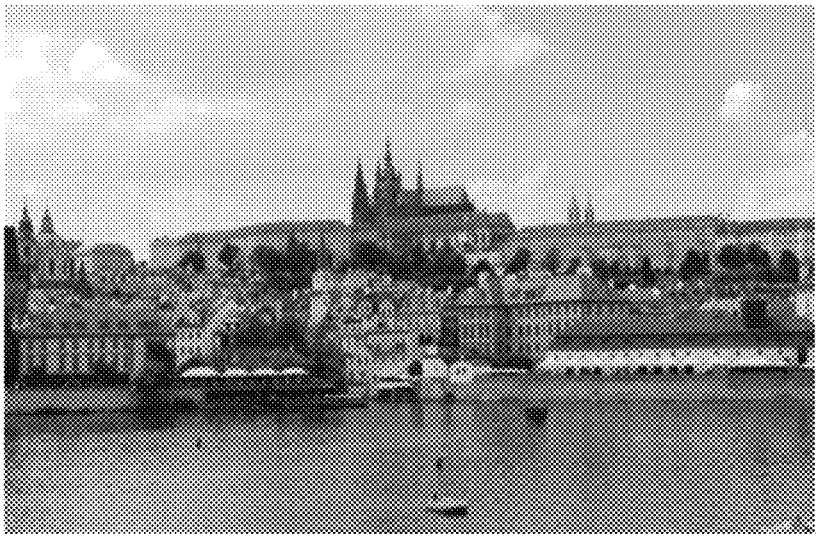

When there is a large number of W images as in the second example of FIG. 16, it is possible to increase only W luminance without varying RGB luminances in the control method (CAPL) according to the embodiment because independent control can be performed, whereas both the RGB luminances and the W luminance may be increased in the control method (APL) according to the comparative example.

Figure 17:
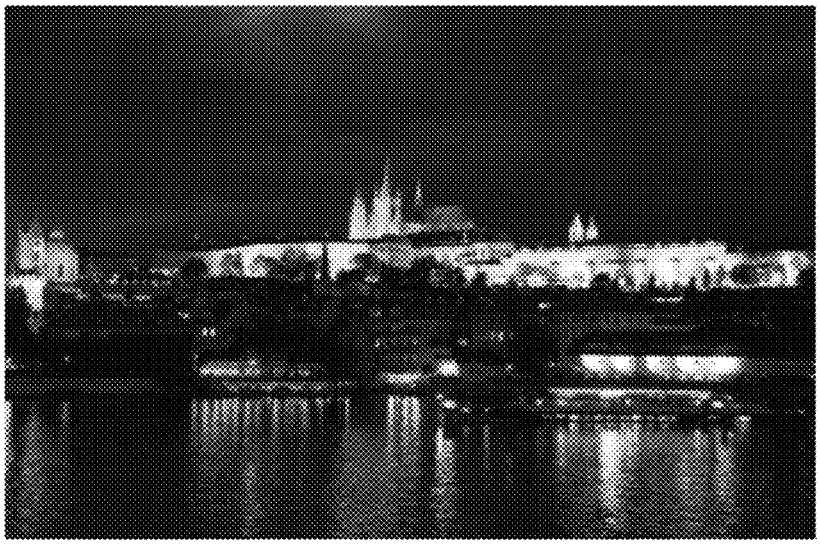

When there is a small number of W images as in the third example of FIG. 17, it is possible to decrease W luminance instead of increasing RGB luminances in the control method (CAPL) according to the embodiment because independent control can be performed, whereas both the RGB luminances and the W luminance may be decreased in the control method (APL) according to the comparative example.

Figure 18:
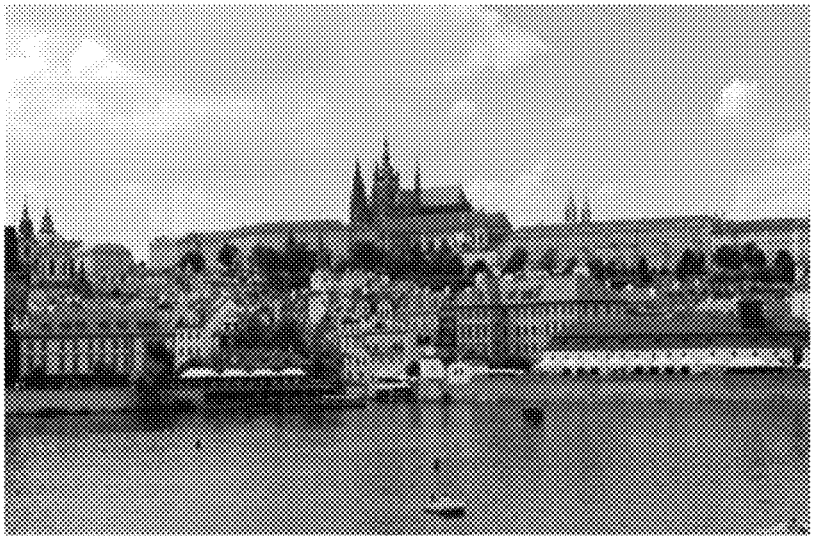

When there is a large number of W images as in the fourth example of FIG. 18, it is possible to increase W luminance instead of decreasing RGB luminances in the control method (CAPL) according to the embodiment because independent control can be performed, whereas both the RGB luminances and the W luminance may be increased in the control method (APL) according to the comparative example.

Referring to the examples of FIGS. 15 to 18, in the peak luminance control method according to the embodiment, the luminance of an image closer to W may increase according to chroma. In this case, since RGB have lower peak luminance curves than that of W, luminance may decrease as chroma increases. In other words, luminance can follow a pure color curve as chroma is high. Briefly, it can be defined as "W image: chroma=0→low APL→luminance increase" and "RGB image: chroma=100→high APL→pure color PLC set luminance".

However, when a W image and an RGB image are present together, unlike the above-described examples, RGB luminances may also increase according to W luminance. That is, the RGB luminances can also increase simultaneously with the W luminance. This operation is possible because at least one of the first average picture level that does not take a chroma component into account and the second average picture level taking the chroma component into account can be calculated depending on an input image, and the luminance can be controlled based on the calculated average picture level.

As described above, the present invention has the effect of increasing the luminance of full white within a range within which the lifespan can be maintained without deterioration of picture quality according to the chroma of an input data signal by using high-efficiency characteristics of W sub-pixels. In addition, the present invention has the effect of reducing power consumption while enabling picture quality enhancement for increasing W luminance in consideration of color additivity.

It will be apparent to those skilled in the art that various modifications and variations can be made in the light emitting display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A light emitting display device comprising:

a display panel including a red sub-pixel, a green sub-pixel, a blue sub-pixel and a white sub-pixel;

a driver configured to drive the display panel; and a timing controller configured to control the driver, wherein W peak luminance derived by the white sub-pixels is higher than a sum of RGB peak luminances derived by the red sub-pixel, the green sub-pixel and the blue sub-pixel when the display panel displays an image, and wherein the timing controller calculates at least one of a first average picture level that does not take a chroma component into account and a second average picture level taking the chroma component into account according to an input image at the time of calculating an average picture level for an image to be displayed on the display panel.

2. The light emitting display device of claim 1, wherein the timing controller generates a peak luminance control signal for controlling the W peak luminance to be higher than the sum of the RGB peak luminances based on the second average picture level.

3. The light emitting display device of claim 1, wherein the second average picture level is calculated based on the following formula, second average picture level=(total pixel sum (MAX(R,G,B)/255×((MAX(R,G,B)−(1−chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

4. The light emitting display device of claim 1, wherein the timing controller generates a peak luminance control signal for independently controlling W luminance derived by the white sub-pixels and independently controlling RGB luminances derived by the red sub-pixel, the green sub-pixel and the blue sub-pixel, respectively.

5. The light emitting display device of claim 1, wherein the timing controller generates a peak luminance control signal for decreasing W luminance derived by the white sub-pixels without changing RGB luminances derived by the red sub-pixel, the green sub-pixel and the blue sub-pixel when there is a predetermined number of white images in an input image.

6. The light emitting display device of claim 1, wherein the timing controller generates a peak luminance control signal for increasing W luminance derived by the white sub-pixels without changing RGB luminances derived by the red sub-pixel, the green sub-pixel and the blue sub-pixel when there is a predetermined number of white images in an input image.

7. The light emitting display device of claim 1, wherein the timing controller generates a peak luminance control signal for decreasing W luminance derived by the white sub-pixels instead of increasing RGB luminances derived by the red sub-pixel, the green sub-pixel and the blue sub-pixel when there is a predetermined number of white images in an input image.

8. The light emitting display device of claim 1, wherein the timing controller generates a peak luminance control signal for increasing W luminance derived by the white sub-pixels instead of decreasing RGB luminances derived by the red sub-pixel, the green sub-pixel and the blue sub-pixel when there is a predetermined amount of white images in an input image.

9. A method of driving a light emitting display device including a display panel including a red sub-pixel, a green sub-pixel, a blue sub-pixel and a white sub-pixel, a driver for driving the display panel, and a timing controller for controlling the driver, the method comprising:

calculating at least one of a first average picture level that does not take a chroma component into account and a second average picture level taking a chroma component into account according to an input image; and generating a peak luminance control signal based on the first average picture level or the second average picture level, wherein W peak luminance derived by the white sub-pixels is higher than a sum of RGB peak luminances derived by the red sub-pixel, the green sub-pixel and the blue sub-pixel when the display panel displays an image.

10. The method of claim 9, wherein the second average picture level is calculated based on the following formula, second average picture level=(total pixel sum (MAX(R,G,B)/255×((MAX(R,G,B)−(1−chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

11. A light emitting display device comprising:

a display panel including a red sub-pixel, a green sub-pixel, a blue sub-pixel and a white sub-pixel;

a driver configured to drive the display panel; and a timing controller configured to control the driver, to calculate an average picture level taking a chroma component into account according to an input image, and to generate a peak luminance control signal for controlling W peak luminance derived by the white sub-pixels to be higher than a sum of RGB peak luminances derived by the red sub-pixel, the green sub-pixel and the blue sub-pixel based on the average picture level.

12. The light emitting display device of claim 11, wherein the display panel displays an image in which W peak luminance is higher than a sum of RGB peak luminances in response to the peak luminance control signal.

13. The light emitting display device of claim 11, wherein the average picture level is calculated based on the following formula, average picture level=(total pixel sum (MAX(R,G,B)/255×((MAX(R,G,B)−(1−chroma gain))×MIN(R,G,B))/MAX(R,G,B)))/total pixel count)×100, wherein the total pixel sum is a sum of all pixels, MAX(R,G,B) is a maximum value of RGB data signals, MIN(R,G,B) is a minimum value of the RGB data signals, the chroma gain is a gain value according to a chroma component, and the total pixel count is a count value of all pixels.

* * * * *